US006486622B2

(12) United States Patent
Sluyterman

(10) Patent No.: US 6,486,622 B2
(45) Date of Patent: Nov. 26, 2002

(54) COLOR DISPLAY DEVICE WITH A DEFLECTION-DEPENDENT DISTANCE BETWEEN OUTER BEAMS

(75) Inventor: Albertus Aemilius Seyno Sluyterman, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/817,195

(22) Filed: Mar. 26, 2001

(65) Prior Publication Data

US 2002/0047652 A1 Apr. 25, 2002

(30) Foreign Application Priority Data

Mar. 28, 2000 (EP) ..... 00201118

(51) Int. Cl.[7] ..... G09G 1/04; H01J 29/70
(52) U.S. Cl. ..... 315/364; 315/371; 315/368.11
(58) Field of Search ..... 315/364, 364.11, 315/368.24, 368.25, 368.27, 369, 370, 391

(56) References Cited

U.S. PATENT DOCUMENTS

| | | | | |
|---|---|---|---|---|
| 4,864,195 A | | 9/1989 | Masterton | 315/371 |
| 5,204,585 A | * | 4/1993 | Chen | 315/15 |
| 5,361,020 A | * | 11/1994 | Hedrick | 315/369 |
| 6,307,333 B1 | * | 10/2001 | Sluyterman et al. | 315/368.28 |

FOREIGN PATENT DOCUMENTS

| | | | |
|---|---|---|---|
| EP | 0218961 A1 | 9/1986 | |
| EP | 0292944 A2 | 5/1988 | |
| WO | WO9934392 | 7/1999 | ..... H01J/29/70 |
| WO | WO0033349 | 11/1999 | |

OTHER PUBLICATIONS

Patent Abstracts of Japan, vol. 015, No. 047, P–1162, Feb. 1991.

* cited by examiner

*Primary Examiner*—Don Wong
*Assistant Examiner*—Tuyet T. Vo

(57) ABSTRACT

A color display device comprises an electron gun, a display screen and a color selection electrode as well as a deflection means. The distance between the electron beams is dynamically varied, i.e. the distance between the electron beams in the deflection plane decreases as the beams are deflected in at least one direction. The decrease of the distance enables the distance between the color selection electrode and the display screen to be increased in that direction. As a result, the curvature of the color selection electrode is increased, which has a position effect on the strength, doming and microphonics of the color selection electrode. The distance is dynamically varied by first and second means, the first means being arranged in or near the pre-focusing parts of the electron gun. Said first means comprise magnetic means outside the neck of the CRT for generating dynamically varying magnetic fields, and magnetic field conducting means to conduct the fields to a position near the electron beams.

3 Claims, 4 Drawing Sheets

COLOR DISPLAY DEVICE WITH A DEFLECTION-DEPENDENT DISTANCE BETWEEN OUTER BEAMS

BACKGROUND OF THE INVENTION

The invention relates to a color display device comprising a color cathode ray tube including an in-line electron gun for generating three electron beams, a color selection electrode and a phosphor screen on an inner surface of a display window, and a means for deflecting the electron beams across the color selection electrode, the color display device comprising a first and a second means arranged at some distance from each other to dynamically influence the convergence of the electron beams so as to decrease the distance between the electron beams at the location of the deflection plane as a function of the deflection in at least one deflection direction, the first means being arranged in or near the pre-focusing portion of the electron gun.

Such a display device is known from international patent application no. WO99/34392.

The aim is to make the outer surface of the display window flatter, so that the image represented by the color display device is perceived by the viewer as being flat. However, an increase of the radius of curvature of the outer surface will lead to an increase of a number of problems. The radius of curvature of the inner surface of the display window and of the color selection electrode should also increase, and, as the color selection electrode becomes flatter, the strength of the color selection electrode decreases and hence the sensitivity to doming and vibrations increases. An alternative solution to this problem would be to curve the inner surface of the display window more strongly than the outer surface. By virtue thereof, a shadow mask having a relatively small radius of curvature can be used. As a result, doming and vibration problems are reduced, but, other problems occur instead. The thickness of the display window is much smaller in the center than at the edges. As a result, the weight of the display window increases and the intensity of the image decreases substantially towards the edges.

The known color display device comprises a first and a second means arranged at some distance from each other to dynamically influence the convergence of the electron beams so as to decrease the distance between the electron beams at the location of the deflection plane as a function of the deflection in at least one deflection direction. By virtue thereof, the distance between the electron beams (also referred to as the 'pitch') in the plane of deflection can be changed dynamically in such a manner that this distance decreases as the deflection increases. By dynamically changing this distance (the pitch) as a function of deflection, and hence as a function of the x and/or y coordinate(s), the distance between the display window and the color selection electrode can increase in the relevant deflection direction. The shape of the inner surface of the display window and the distance between the display window and the color selection electrode determine the shape, and in particular the curvature, of the color selection electrode.

Since the distance between the electron beams decreases as a function of the deflection, the distance between the display window and the color selection electrode increases and the shape of the color selection electrode can deviate more from the shape of the inner surface of the display window than in previous cathode ray tubes, in particular the curvature of the color selection electrode is larger. Such a larger curvature (or, in other words, a smaller radius of curvature) increases the strength of the color selection electrode and reduces doming and microphonics.

In the known color display device, the first means comprises one or more components of the pre-focusing portion of an electron gun. The outermost apertures of the G2 and G3 electrodes are offset with respect to each other and a dynamic potential difference is applied between them. In this manner, a dynamic electric field is used to influence the convergence (or divergence) of the electron beams.

Providing such a dynamic potential difference, however, entails providing a dynamic voltage difference between electrodes. This requires a separate voltage supply circuit, which is relatively expensive. Some guns use a DAF (Dynamic Astigmatism and Focus) design in which a dynamic voltage is supplied to the G3 electrode. This dynamic voltage, however, is usually mainly dependent on the horizontal deflection, rather than on the vertical deflection. The dynamic voltage range is very limited as a function of vertical deflection enabling only limited influence on the convergence.

SUMMARY OF THE INVENTION

It is an object of the invention to provide a color cathode ray tube of the type mentioned in the opening paragraph, in which the outer surface may be flat or substantially flat, while, at the same time, the above problems are overcome or reduced.

To this end, the color display device in accordance with the invention is characterized in that the first means comprises generating means for generating, outside the neck of the cathode ray tube, a dynamic magnetic field and conducting means inside the neck of the cathode ray tube and in or near the prefocusing portion of the electron gun to conduct the magnetic field to a position near the outer electron beams so as to form a local magnetic field for influencing the electron beams.

In the device in accordance with the invention, there is no need for an extra supply circuit for supplying a dynamic electric potential. In the color display device in accordance with the invention, a local magnetic field is generated for influencing the electron beams. An important advantage is also that this correcting field may be used at will, i.e. the set maker may make use of the invention when wanted, without having to change the gun or the supply circuit to the gun.

Preferably, the conducting means are attached to the G2 or G1 electrode. This enables a magnetic field to be attained very close to the cross-overs of the electron beams. Preferably, the conducting means are arranged at a surface of the G2 electrode facing the G1 electrode or at a surface of the G1 electrode facing the G2 electrode, placing the local magnetic fields even closer to the cross-over. By placing the local magnetic fields close to the cross-overs of the electron beams, a situation is attained where the beams remain converged on the screen. This is due to the fact that the main lens has the task of creating a sharp image of the cross-overs on the screen.

These and other aspects of the invention are apparent from and will be elucidated with reference to the embodiments described hereinafter.

BRIEF DESCRIPTION OF THE DRAWING

In the drawing.

The Figures are not drawn to scale. In the Figures, like reference numerals generally refer to like parts.

DESCRIPTION OF THE PREFERRED EMBODIMENT

Figure 1:
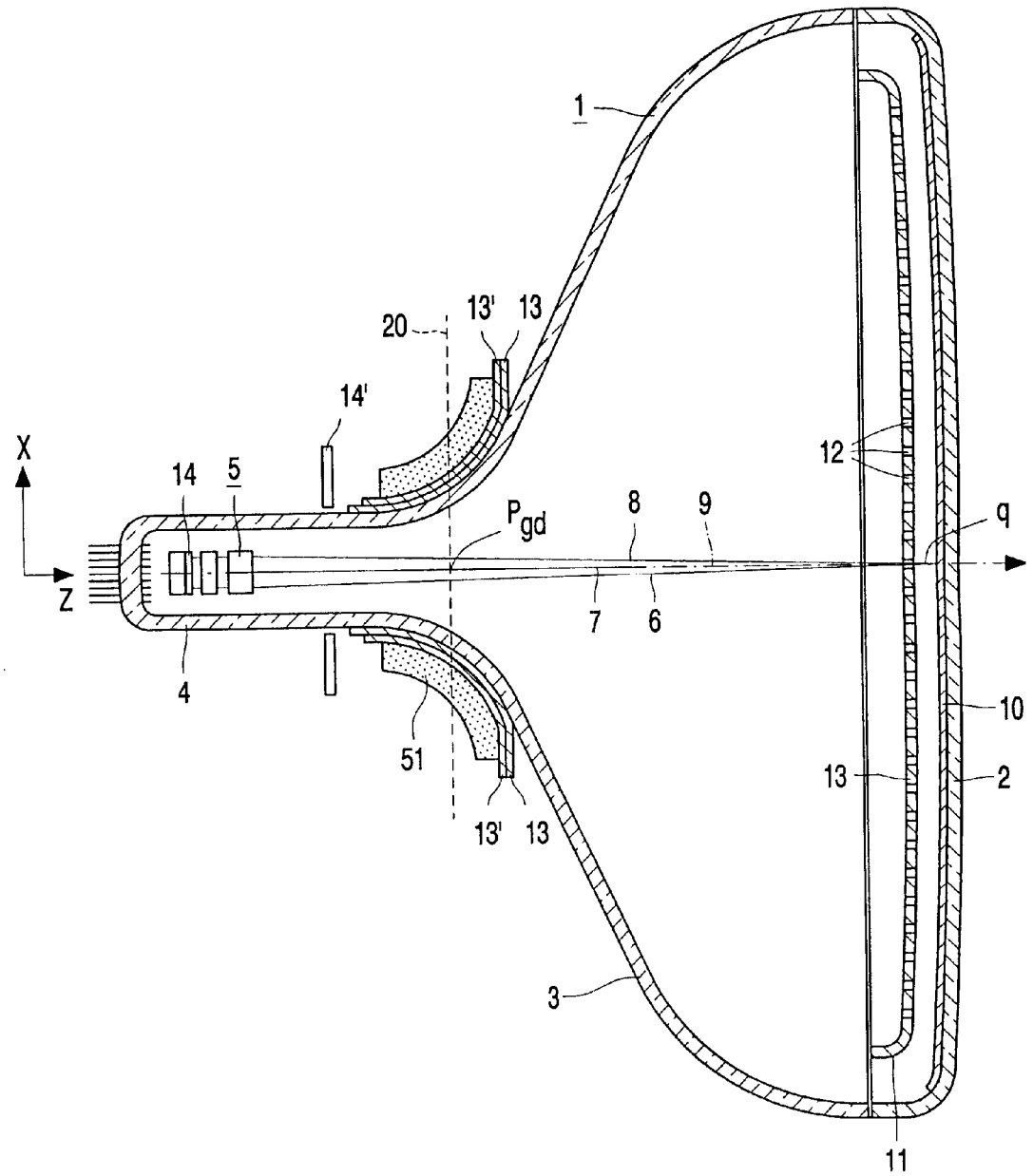
FIG. 1 is a sectional view of a display device, in which the invention is schematically shown.

The display device comprises a cathode ray tube, in this example a color display tube, having an evacuated envelope 1 which includes a display window 2, a cone portion 3 and a neck 4. The neck 4 accommodates an electron gun 5 for generating three electron beams 6, 7 and 8 which extend in one plane, the in-line plane, which in this case is the plane of the drawing. In the undeflected state, the central electron beam 7 substantially coincides with the tube axis 9. The inner surface of the display window is provided with a display screen 10. Said display screen 10 comprises a large number of phosphor elements which luminesce in red, green and blue. On their way to the display screen, the electron beams are deflected across the display screen 10 by means of an electromagnetic deflection unit 51 and pass through color selection electrode 11 which is arranged in front of the display window 2 and comprises a thin plate having apertures 12. The three electron beams 6, 7 and 8 pass through the aperture 12 of the color selection electrode at a small angle relative to each other and hence each electron beam impinges only on phosphor elements of one color. The deflection unit 51 comprises, in addition to a coil holder 13, coils 13' for deflecting the electron beams in two mutually perpendicular directions. The display device further includes means for generating voltages which, during operation, are fed to components of the electron gun via feedthroughs. The deflection plane 20 is schematically indicated as well as the distance $P_{gd}$ between the electron beams 6 and 8 in this plane, and the distance q between the color selection electrode and the display screen.

Figure 2:
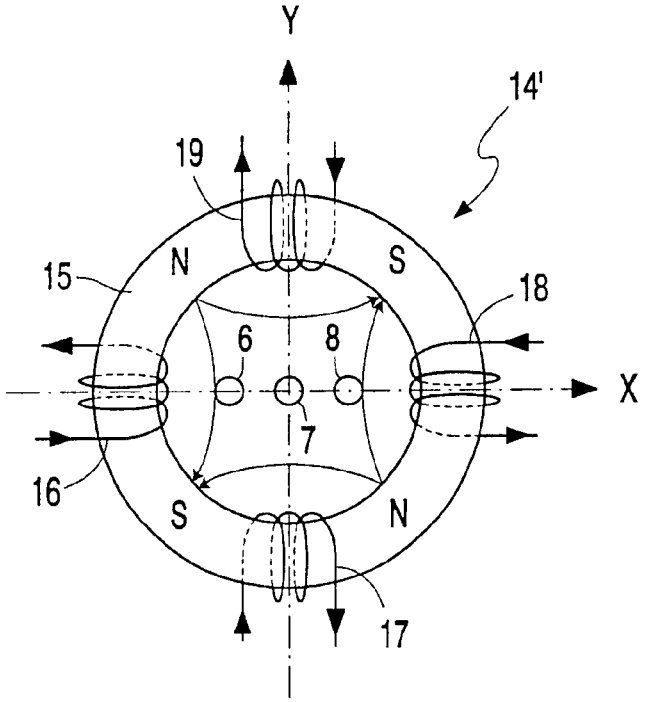
FIG. 2 schematically shows a number of quadruple elements.

The color display device comprises two means 14, 14', whereby a means 14 is used, in operation, to dynamically bend, i.e. as a function of the deflection in a direction, the outermost electron beams more towards each other, and a further means 14' which serves to dynamically bend the outermost electron beams more away from each other. FIG. 2 shows an example of means 14'. In this case, means 14' comprises a ring core of a magnetizable material on which four coils 16, 17, 18 and 19 are wound in such a manner that, upon excitation (using, for example, a current which is proportional to the square of the line deflection current), a 45° 4-pole field is generated. The coils are wound in such a manner, and the direction in which, in operation, current passes through the coils is such that a 45° 4-pole field is generated having an orientation which acts opposite to the action of means 14 in the electron gun. The combined action of the means 14 and 14' causes a change in the distance $P_{gd}$. The convergence of the beams is, in first order approximation not affected by the combined action of means 14 and 14'. The distance $P_{gd}$ can thus be changed, making it larger or smaller. In the display device according to the invention, the distance $P_{gd}$ is decreased as a function of the deflection. Within the concept of the invention, the combined effect on the distance $P_{gd}$ of the means 14 and 14' may be, for undeflected electron beams, an increase or a decrease of the distance $P_{gd}$. The invention relates to the change of the distance $P_{gd}$ as a function of deflection. Preferably, the combined action of means 14 and 14' is, for undeflected beams, an increase of the distance $P_{gd}$, in comparison with a situation where the means are not present (or inactive), the increase being such that, as the distance $P_{gd}$ decreases as a function of deflection, the total effect of the first and second means becomes zero between ⅓ and ⅔ of the total deflection. Such an embodiment is preferred because the gun is commonly made in such a fashion that the image is as good as possible for a certain gun pitch, while deviations from that gun pitch introduce small errors. By having the influence of the means 14 and 14' fluctuating around zero, such errors are minimized.

FIG. 1 schematically shows the invention. The three electron beams 6, 7 and 8 are separated from each other in the plane of deflection (a plane 20 which is situated approximately in the center of the deflection unit 11) by a distance $P_{gd}$. The distance q between the color selection electrode 12 and the display screen 10 is inversely proportional to the distance $P_{gd}$.

The color display device in accordance with the embodiment of the invention shown in FIG. 1 comprises two means (14, 14'), which are positioned at some distance from each other and are used to vary the distance $P_{gd}$ as a function of the deflection in such a manner that this distance $P_{gd}$ decreases as a function of the deflection in at least one direction. Means 14 comprises (see also FIG. 6) means outside the neck for generating dynamic magnetic fields and conducting means inside the neck for conducting the dynamic magnetic field to a position near the outer electron beams. There is no need for generation of dynamic voltages in or near the prefocusing part, so that no extra dynamic voltage has to be generated.

Preferably, the means can be suitably used to dynamically vary the distance $P_{gd}$ between the electron beams in at least the y-(vertical) direction. The advantage resulting from a flatter construction of the display window is largest in the y-direction.

Figure 3:
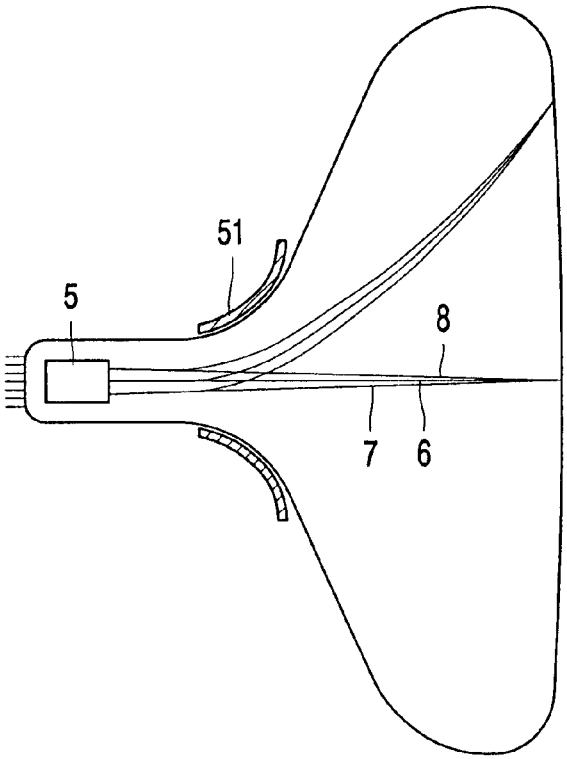
FIGS. 3 and 4 show, by means of schematic, sectional views of color display devices, a number of recognitions on which the invention is based.
Figure 4:
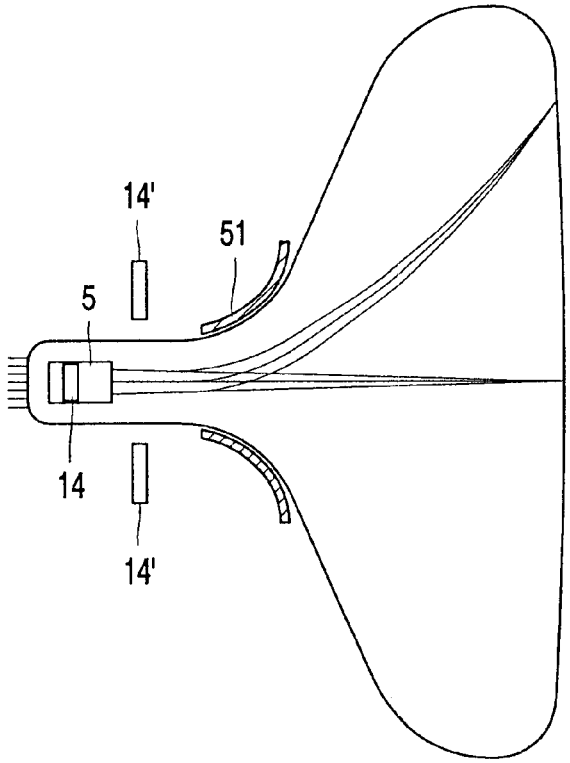

This effect is illustrated in FIGS. 3 and 4. FIG. 3 shows a color display device without the means 14, 14'. The distance between the electron beams at the location of the deflection unit 51 does not change as a function of the deflection. In FIG. 4, the means 14, 14' do change this distance, i.e. the means 14 bends the electron beams towards each other, and the means 14' bends the electron beams in opposite directions. As a result, the distance between the electron beams is smaller for deflected electron beams than for undeflected electron beams. Since the distance $P_{gd}$ is smaller, the distance q may increase. The increase of the distance q leads to an increase of the curvature of the selection electrode. This has a positive effect on the strength of the color selection electrode, while doming and microphonics decrease.

In accordance with an alternative embodiment, the means 14' may be integrated in the deflection unit either by winding a separate coil onto the deflection unit to generate a dynamic electromagnetic 4-pole field or by modifying the windings of an existing deflection coil in such a manner that the deflection coils generate a dynamic electromagnetic 4-pole field.

The means 14 is integrated in the electron gun 5. In the known color display devices, dynamic voltage differences are applied between two or more apertures in subsequent electrodes, the center line of the apertures in these electrodes being displaced relative to each other. An electric field is thereby generated which comprises a component at right angles to the direction of movement of the electron beams (in the x-direction), so that the beams are moved towards each other. More in particular, the means 14 is integrated in the pre-focusing portion of the electron gun, outermost apertures in the G2 and G3 electrodes are displaced relative to each other and a dynamic component-containing potential difference is applied between the electrodes. As a result of the relative displacement of the apertures in the electrodes, the electric field generated, in operation, between the electrodes comprises a component transverse to the direction of propagation of the outermost electrodes, so that the convergence of the electron beams is influenced. The dynamic component in the voltage applied between the electrodes causes a dynamic adaptation of the convergence, whereby the electron beams are moved towards each other as a function of the deflection. A result of the fact that the convergence of the beams in the prefocusing portion is changed dynamically is that the position of the outermost electron beams in the main lens is also subject to a dynamic variation. This change will also cause a change of the direction of the electron beams, which generally results in the electron beams moving in opposite directions. The second means 14' may be partially constituted by the main lens per se, to which a dynamic voltage is applied or not applied.

Figure 5:
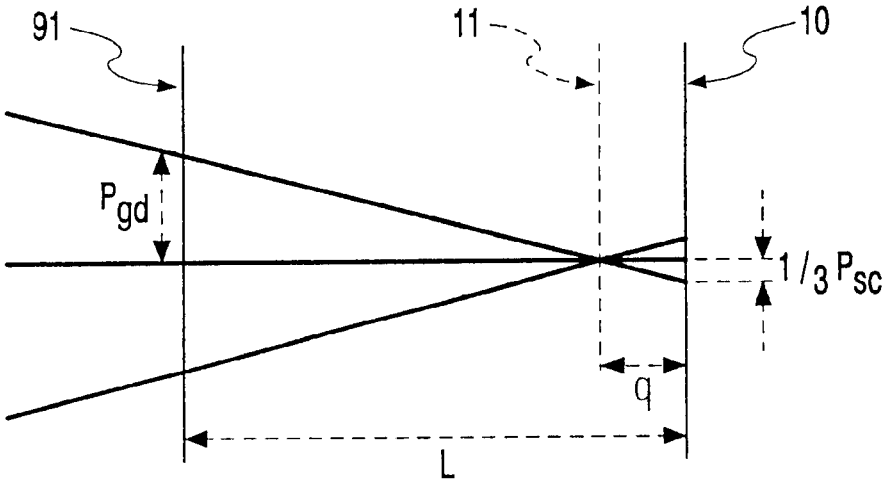
FIG. 5 shows the relation between the gun pitch and the screen pitch

FIG. 5 shows the relation between the gun pitch $P_{gd}$ (i.e. the distance between the central and outer beams at the deflection plane 91 of the deflection unit), the screen pitch $P_{sc}$ (i.e. the distance between the central and outer beams at the screen 10), the distance L between the deflection plane and the screen, and the distance q between the shadow mask and the screen. As they leave the gun, the three beams 6, 7, 8 are converged on the screen 10. FIG. 5 shows that, for a given screen pitch $P_{sc}$ and a given distance L, the distance q increases when the gun pitch $P_{gd}$ decreases. Mathematically this relation is given by:

$$q=(P_{sc}*L)/(3*P_{gd}+P_{sc}).$$

In the invention, the mask-to-screen distance q can be varied for each point on the screen by varying the gun pitch as a function of deflection, and additional curvature of the color selection electrode is obtained.

Figure 6:
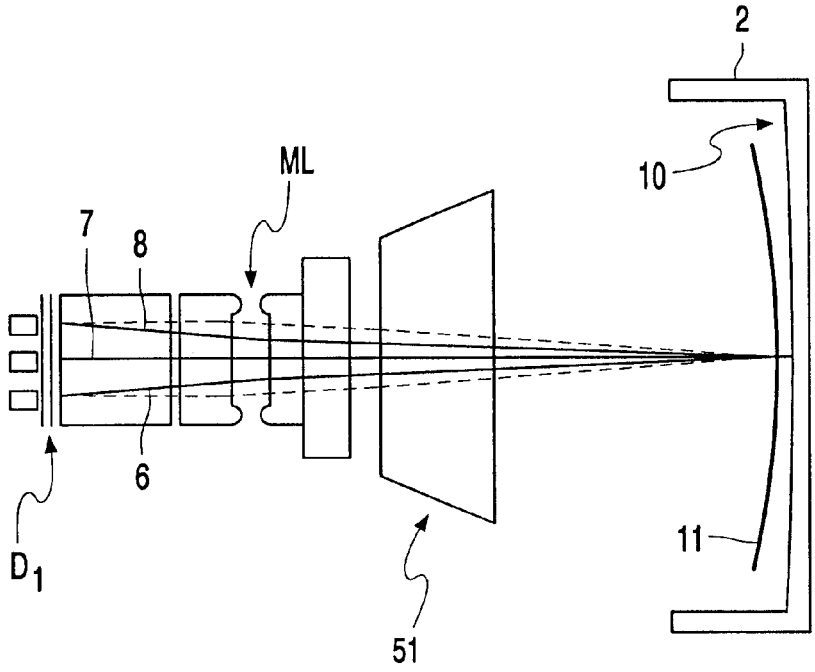
FIGS. 6 and 7 illustrate further details of an embodiment of the invention.

FIG. 6 shows an embodiment of a color display device in accordance with the invention. In this embodiment, a dynamic magnetic field D1 is generated in or near the prefocusing section of the electron gun and an electric field ML is generated between the main lens electrodes. This electric field may have a dynamic component, but preferably does not have a dynamic component. Even without a dynamic component in the main lens field, a dynamic effect may still be attained as follows. The application of the dynamic magnetic field changes the distance between the electron beams, and thereby the position of the electron beams in the main lens. The electron beams are moved towards each other and will, as a consequence, enter the main lens closer to each other. The outer electron beams entering the main lens closer to each other (i.e. at the 'inside' of the lens) will experience an outward force. This outward force is dependent on the position of the electron beams, which position is dynamically varied by the dynamically varied magnetic field. Thus, although the electric field of the main lens may be static, the influence of said field on the convergence is dynamic.

Figure 7:
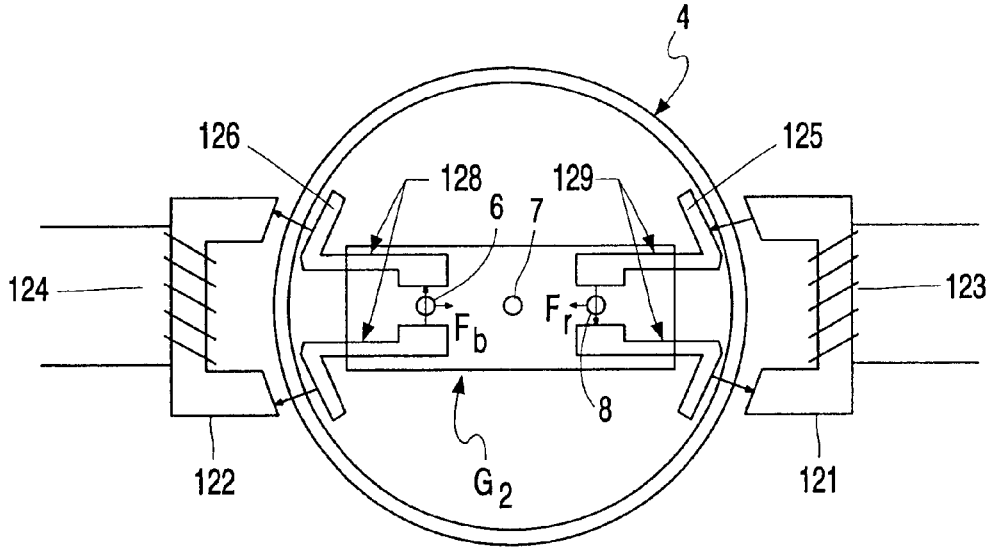

FIG. 7 shows in more detail an example of a color display device in accordance with the invention. A dynamic magnetic quadrupolar field is generated near the grid G2. Two U-shaped magnetic cores 121, 122 are provided with coils 123, 124 for generating magnetic fields. Inside the neck 4 of the envelope and near the grid G2, soft magnetic (conducting) elements 125, 126, 128, 129 are provided. The magnetic field formed between the parts 128, 129 generates forces $F_r$ and $F_b$ on the outer electron beams 6 and 8, thus changing the distance between the electron beams at the plane of deflection. The advantage of the invention is also that because the forces $F_b$ and $F_r$ are not made by electric fields, they can be made substantially homogeneous and can be better controlled.

Preferably, the conducting elements are attached to the G2 or G1 electrode, preferably at a surface of the G2 electrode facing the G1 electrode or at a surface of the G1 electrode facing the G2 electrode. The magnetic field is then formed very near or at the cross-over of the electron beams.

These are preferred embodiments because the position of the cross-over and the form of the electron beams at the cross-over is influenced. The main lens focuses the cross-over on the screen. In these embodiments, the electron beams remain converged on the screen and a second means for manipulating the beams to maintain good convergence of the beams is not needed. An added advantage is that there is no or hardly any electron beam spot side effect (a change in the size and/or shape of the spot on the screen) in these embodiments.

The invention can briefly be summarized as follows: a color display device comprises an electron gun, a display screen and a color selection electrode as well as a deflection means. The distance between the electron beams is dynamically varied, i.e. the distance between the electron beams in the deflection plane decreases as the beams are deflected in at least one direction. The decrease of the distance enables the distance between the color selection electrode and the display screen to be increased in that direction. As a result, the curvature of the color selection electrode is increased, which has a positive effect on the strength, doming and microphonics of the color selection electrode. The distance is dynamically varied by first and second means, the first means being arranged in or near the pre-focusing parts of the electron gun. Said first means comprise magnetic means outside the neck of the CRT for generating dynamically varying magnetic fields, and magnetic field conducting means to conduct the fields to a position near the electron beams.

What is claimed is:

1. A color display device comprising a color cathode ray tube having a neck and including an in-line electron gun for generating inner and first and second outer electron beams, a color selection electrode and a phosphor screen on an inner surface of a display window, and a means for deflecting the electron beams across the color selection electrode, the color display device comprising a first and a second means arranged at some distance from each other to dynamically influence the convergence of the electron beams so as to decrease the distance $P_{gd}$ between the electron beams at the location of a deflection plane as a function of the deflection in at least one deflection direction (x, y), the first means being arranged in or near a pre-focusing portion of the electron gun, said first means comprising generating means for generating, outside the neck of the cathode ray tube, a dynamic magnetic field and conducting means inside the neck of the cathode ray tube and in or near a pre-focusing portion of the electron gun to conduct the magnetic field to a position near the outer electron beams so as to form a local magnetic field for influencing the electron beams.

2. A color display device as claimed in claim 1, characterized in that the conducting means are disposed near a G2 electrode of the electron gun.

3. A color display device as claimed in claim 1, characterized in that the conducting means are arranged at a surface of the G2 electrode.

* * * * *